US006233739B1

(12) United States Patent
Spence

(10) Patent No.: US 6,233,739 B1
(45) Date of Patent: May 22, 2001

(54) VEST FOR A GOLFER

(76) Inventor: Allan G. Spence, 629 Henderson Ave., Staten Island, NY (US) 10310

( * ) Notice: Subject to any disclaimer, the term of this patent is extended or adjusted under 35 U.S.C. 154(b) by 0 days.

(21) Appl. No.: 09/320,292

(22) Filed: May 26, 1999

(51) Int. Cl.[7] ..... A41D 1/04; A63B 53/00

(52) U.S. Cl. ..... 2/94; 2/102; 2/250; 2/913; 224/684; 473/288

(58) Field of Search ..... 2/102, 94, 247, 2/249, 250, 251, 912, 913; 473/288; 224/682, 684; 206/315.2

(56) References Cited

U.S. PATENT DOCUMENTS

| | | | | |
|---|---|---|---|---|
| D. 311,085 | | 10/1990 | Moen | D2/190 |
| 782,955 | | 2/1905 | Emens | 473/307 |
| 3,893,670 | | 7/1975 | Franchi | 473/288 |
| 4,340,227 | * | 7/1982 | Dopkowski | 473/288 |
| 4,506,888 | | 3/1985 | Nardozzi, Jr. | 473/307 |
| 4,637,076 | * | 1/1987 | Tartt et al. | 2/102 |
| 4,669,127 | | 6/1987 | Swanson | 2/46 |
| 4,852,782 | * | 8/1989 | Wu et al. | 224/682 X |
| 5,247,707 | | 9/1993 | Parker et al. | 2/102 |
| 5,278,998 | * | 1/1994 | Book | 2/102 |
| 5,465,425 | * | 11/1995 | Crispin | 2/102 |
| 5,549,116 | * | 8/1996 | Mauer | 2/102 X |
| 5,755,110 | * | 5/1998 | Silvas | 2/102 X |

FOREIGN PATENT DOCUMENTS

0535848A1 7/1993 (EP) .

* cited by examiner

*Primary Examiner*—Peter Nerbun
(74) *Attorney, Agent, or Firm*—Richard L. Miller

(57) ABSTRACT

A vest for a golfer. The vest includes a carrying mode, a wearing mode, a chest-engaging portion that engages the chest of the golfer, a back-engaging portion that is attached to the chest-engaging portion and engages the back of the golfer, and a, knock down golf club. The chest-engaging portion has six golf club head-holding pockets that are disposed in two columns of. Three pockets each and are small for holding detachable golf club heads. The back-engaging portion has a pair of golf club shaft-holding pockets that are disposed side by side, and are long, narrow, and vertically-oriented for holding segmented golf club shafts. The knock down golf club includes a shaft that includes a pair of separate portions that are disposed end to end in collinear relationship and threadably engaged to each other so ;Is to allow the shaft to be separated into the pair of separate portions and stored in one of the pair of golf club shaft-holding pockets. The knock down golf club further includes a golf club head that is detachably threaded onto the shaft so as to allow the golf club head to be separated from the shaft and stored in one of the six golf club head-holding pockets.

27 Claims, 2 Drawing Sheets

FIG.6
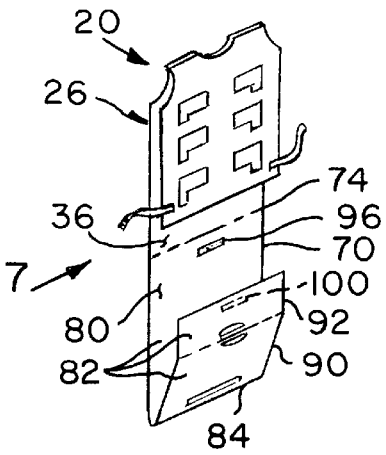
FIG.7
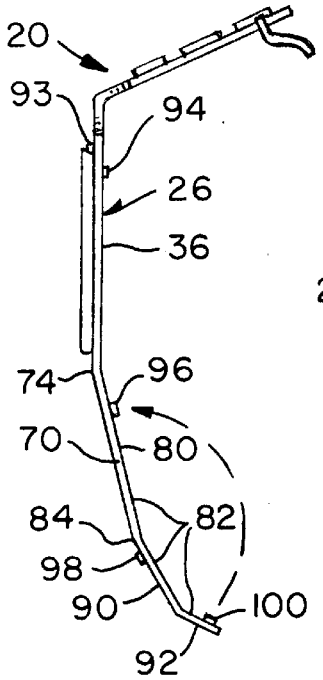
FIG.8
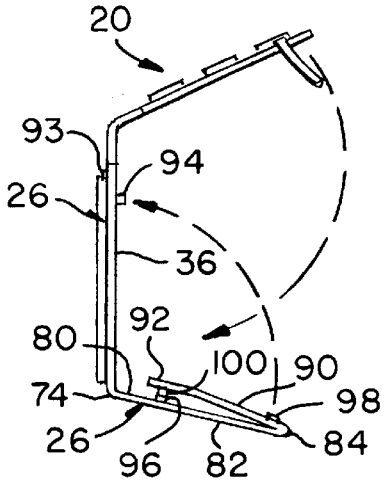
FIG.9
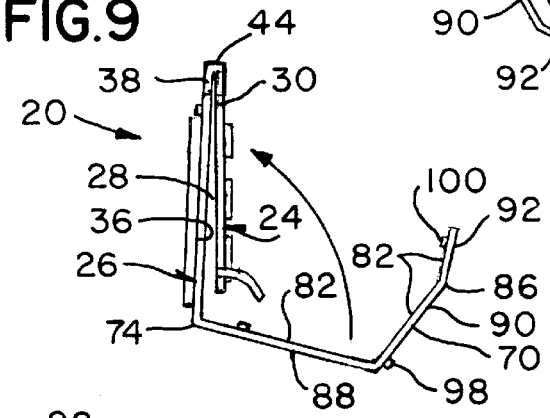
FIG.10
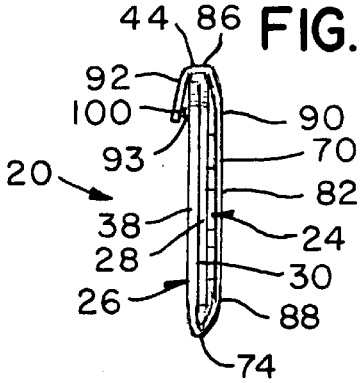
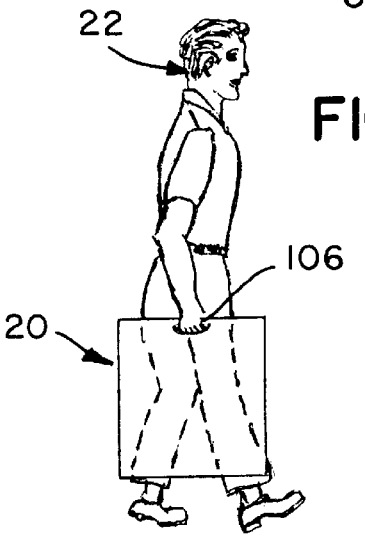
FIG.12
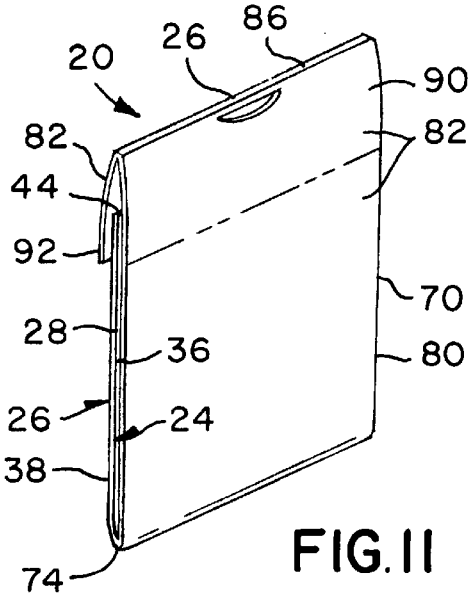
FIG.11

VEST FOR A GOLFER

BACKGROUND OF THE INVENTION

1. Field of the Invention

The present invention relates to a vest. More particularly, the present invention relates to a vest for a golfer.

2. Description of the Prior Art

Numerous innovations for vests and golf clubs have beer provided in the prior art that will be described. Even though these innovations may be suitable for the specific individual purposes to which they address, however, they differ from the present invention.

A FIRST EXAMPLE, U.S. Pat. No. Des. 311,085 to Moen teaches the ornamental design for a vest for nurses.

A SECOND EXAMPLE, U.S. Pat. No. 782,955 to Emens teaches in golf club that includes a removable head, a socket formed on said head, catches projecting from the end of said socket, of a stick or shaft, a sleeve or ferrule on the end of said stick or shaft, said ferrule having an enlarged cylindrical end portion, a collar integral on the end of said enlarged portion, a dowel or pintle on the end of the enlarged portion of said ferrule, a collar loosely mounted to turn on said enlarged cylindrical end portion and abutting said integral collar, said cylindrical portion recessed or slotted to receive said catches, and cams formed on the sides of said loose collar and adapted to engage said catches.

A THIRD EXAMPLE, U.S. Pat. No. 3,893,670 to Franchi teaches a golf club having interchangeable heads, wherein the golf club comprises a shaft having a support plate secured to the lower end thereof. A plurality of interchangeable heads are adapted for attachment to the support plate. The heads each have a projection which projects through an opening formed in the support plate. A movable locking link, such as a spring, is mounted on the support plate and engages the projection for connecting the head to the support plate.

A FOURTH EXAMPLE, U.S. Pat. No. 4,506,888 to Nardozzi, Jr. teaches a putter shaft that has a lower end portion extending angularly relative to the shaft longitudinal axis and is slidably engageable with a guideway in the top of a removable putter head. The guideway extends substantially the length of the putter head and includes an entry at one end portion and a stop at the opposite end portion. The guideway is selectively oriented relative to a striking surface of the putter head so that when a shoulder on the shaft lower end portion abuts the guideway stop, the putter head is in the desired spatial relation with the putter shaft. Cooperating releasable locking devices carried on the lower end portion of the putter shaft and within the guideway of the putter head engage to secure the putter head to the shaft when the putter head is in the operative position on the shaft lower end portion. The cooperating locking devices are easily disengaged to facilitate disconnection of the putter head from the shaft for change of putter heads of different weight and configuration on the shaft, or change of different types of shafts for one or more types of putterheads.

A FIFTH EXAMPLE, U.S. Pat. No. 4,669,127 to Swanson teaches a utility garment for load portage in the shape of a vest containing load carrying compartments on the back and front flaps of the vest. The vest closes at the front, and a waist belt attached to back and front flaps through tie down loops holds the loaded vest to the wearer to prevent shifting of loads and upward creeping of the front flaps and to distribute a portion of the read load directly to the wearer's hip region. A stowable water repellent seat protector hangs from the bottom of the back of the pack for the packer to sit upon.

A SIXTH EXAMPLE, U.S. Pat. No. 5,247,707 to Parker et al. teaches a utility vest with a pair of straps running through the shoulder areas of the vest and terminating in loops that extend proximate to the outer surface of the garment. These straps are engageable with a belt and thereby transfer the weight of items clipped or otherwise attached to the belt to the shoulders of the user, preventing the belt from riding low or sliding down around the user's hips. Additionally, there are a number of pleated and unpleated pockets disposed about the inner and outer surfaces of the vest. On the rear panel of the vest, on of these pockets has contained within it a folded backpack that is integrally attached to the vest. The backpack has a pair of loops on its anterior surface that cooperate with the belt, thus holding the deployed backpack substantially stationary relative to the vest.

A SEVENTH EXAMPLE, European Patent No. 0,535,848, A1 to Kawasaki teaches a golf club comprising an elongate shaft and a Ahead carried at one end of the shaft, the club being characterized by coupling means at said one end of the shaft received within a passage in said head and a fastening device coacting with said coupling means releasably to secure said head to said shaft. The coupling means is fixed to the elongated shaft by means of the rool extending from one end of the coupling means into the shaft where it is blocked by an adhesive.

It is apparent that numerous innovations for vests and golf clubs have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to: provide a vest for a golfer that avoids the disadvantages of the prior art.

ANOTHER OBJECT of the present invention is to provide a vest for a golfer that is simple and inexpensive to manufacture.

STILL ANOTHER OBJECT of the present invention is to provide a vest for a golfer that is simple to use.

BRIEFLY STATED, YET ANOTHER OBJECT of the present invention is to provide a vest for a golfer. The vest includes a carrying mode, a wearing mode, a chest-engaging portion that engages the chest of the golfer, a back-engaging portion that is attached to the chest-engaging portion and engages the back of the golfer, and a knock down golf club. The chest-engaging portion has six golf club head-holding pockets that are disposed in two columns of three pockets each and are small for holding detachable golf club heads. The back-engaging portion has a pair of golf club shaft-holding pockets that are disposed side by side, and are long, narrow, and vertically-oriented for holding segmented golf club shafts. The knock down golf club includes a shaft that includes a pair of separate portions that are disposed end to end in collinear relationship and threadably engaged to each other so as to allow the shaft to be separated into the pair of separate portions and stored in one of the pair of golf club shaft-holding pockets. The knock down golf club further includes a golf club head that is detachably threaded onto the shaft so as to allow the golf club head to be separated from the shaft and stored in one of the six golf club head-holding pockets.

The novel features which are considered characteristic of the present invention are set forth in the appended claims.

The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows:

FIG. 6 is a diagrammatic front perspective view of the first step in folding the vest of the present invention for wearing;

FIG. 7 is an enlarged diagrammatic side elevational view taken generally in the direction of arrow 7 in FIG. 6;

FIG. 8 is a diagrammatic side elevational view of the next step in folding the vest of the present invention for wearing;

FIG. 9 is a diagrammatic side elevational view of the steps in folding the vest of the present invention into a brief case;

FIG. 10 is a diagrammatic side elevational view of the vest of the present invention folded into a brief case;

FIG. 11 is an enlarged diagrammatic perspective view of the vest of the present invention folded into the brief case shown in FIG. 10;

FIG. 12 is a diagrammatic side elevational view of the vest of the present invention folded into the brief case shown in FIG. 11 in use;

LIST OF REFERENCE NUMERALS UTILIZED IN THE DRAWING

20 vest of the present invention

22 golfer

Figures 1, 2, 3, 4, 5, 13, 14:
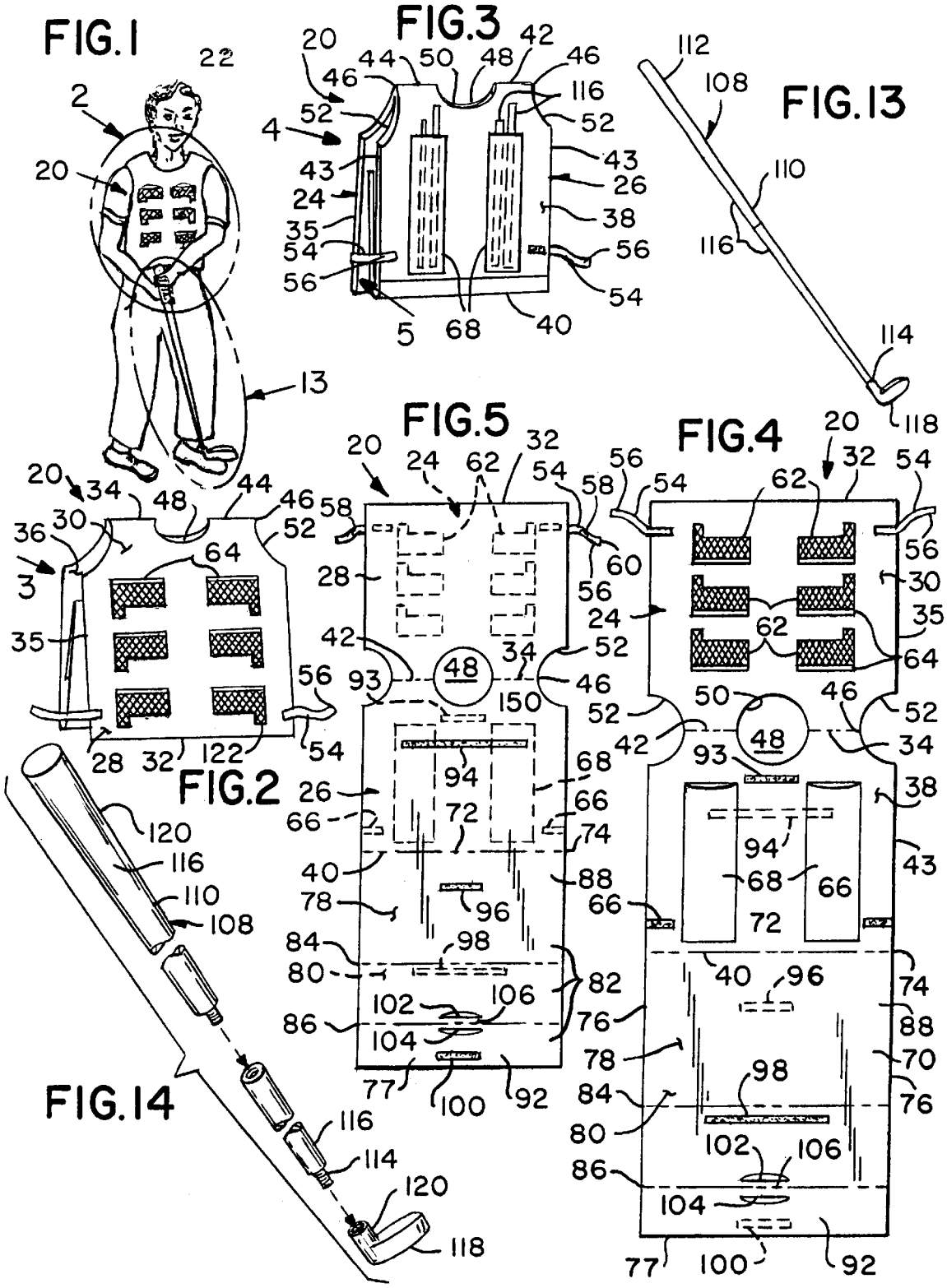
FIG. 1 is a diagrammatic perspective view of the vest of the present invention in the worn position in use.
FIG. 2 is an enlarged diagrammatic front perspective view of the area generally enclosed by the dotted curve identified by arrow 2 in FIG. 1 of the vest of the present invention in the folded position.
FIG. 3 is a diagrammatic rear perspective view taken generally in the direction of arrow 3 in FIG. 2.
FIG. 4 is a diagrammatic top plan view taken generally in the direction of arrow 4 in FIG. 3 of the vest of the present invention in the unfolded position.
FIG. 5 is a diagrammatic bottom plan view taken generally in the direction of arrow 5 in FIG. 3 of the vest of the present invention in the unfolded position.
FIG. 13 is an enlarged diagrammatic perspective view of the area generally enclosed by the dotted curve identified by arrow 13 in FIG. 1 of the collapsible golf club of the present invention.
FIG. 14 is an enlarged exploded diagrammatic perspective view of the collapsible golf club of the present invention shown in FIG. 13.

24 chest-engaging portion for engaging chest of golfer 22

26 back-engaging portion for engaging back of golfer 22

28 chest-engaging face of chest-engaging portion 24 for engaging chest of golfer 22

30 ambient-facing face of chest-engaging portion 24 for facing ambient

32 waist-engaging edge of chest-engaging portion 24 for engaging waist of golfer 22

34 neck and shoulder-engaging edge of chest-engaging portion 24 for engaging neck and shoulders of golfer 22

35 pair of side-engaging edges of chest-engaging portion 24 for engaging sides of golfer 22

36 back-engaging face of back-engaging portion 26 for engaging back of golfer 22

38 ambient-facing face of back-engaging portion 26 for facing ambient

40 waist-engaging edge of back-engaging portion 26 for engaging waist of golfer 22

42 neck and shoulder-engaging edge of back-engaging portion 26 for engaging neck and shoulders of golfer 22

43 pair of side-engaging edges of back-engaging portion 26 for engaging sides of golfer 22

44 common fold line

46 pair of ends of common fold line 44

48 midpoint of common fold line 44

50 neck-engaging cutout in common fold line 44 for engaging neck of golfer 22

52 pair of shoulder-engaging cutouts in common fold line 44 for engaging shoulders of golfer 22

54 pair of side-engaging straps of chest-engaging portion 24 for engaging sides of golfer 22

56 exposed side-engaging strap portion of each side-engaging strap of pair of side-engaging straps 54 of chest-engaging portion 24

58 side-facing face of exposed side-engaging strap portion 56 of each side-engaging strap of pair of side-engaging straps

54 of chest-engaging portion 24 for facing sides of golfer 22

60 first portion of hook and loop fasteners covering side-facing face of exposed side-engaging portion 56 of each side-engaging strap of pair of side-engaging straps 54 of chest-engaging portion 24

62 six golf club head-holding pockets of chest-engaging portion 24

64 flap of each pocket of six golf club head-holding pockets 62 of chest-engaging portion 24 for preventing small golf equipment held therein from unintentionally falling out

66 fourth pair of mating portions of hook and hoop fasteners of back-engaging portion 26

68 pair of golf club shaft-holding pockets of back-engaging portion 26 for holding one of whole and segmented golf club shafts

70 brief case-forming extended portion of back-engaging portion 26

72 first edge of brief case-forming extended portion 70 of back-engaging portion 26

74 first lateral fold line

76 pair of side edges 76 of brief case-forming portion 70 of back-engaging portion 26

77 free lateral edge of brief case-forming portion 70 of back-engaging portion 26

78 first face of brief case-forming portion 70 of back-engaging portion 26

80 second face of brief case-forming portion 70 of back-engaging portion 26

82 three portions of brief case-forming portion 70 of back-engaging portion 26

84 second lateral fold line

86 third lateral fold line

88 first portion of three portions 82 of brief case-forming portion 70 of back-engaging portion 26

90 second portion of three portions 82 of brief case-forming portion 70 of back-engaging portion 26

92 third portion of three portions 82 of brief case-forming portion 70 of back-engaging portion 26

93 fifth portion of hook and loop fasteners of back-engaging portion 26

94 sixth portion of hook and loop fasteners of back-engaging portion 26

96 seventh portion of hook and loop fasteners of first portion 88 of three portions 82 of brief case-forming portion 70 of back-engaging portion 26

98 eighth portion of hook and loop fasteners of second portion 90 of three portions 82 of brief case-forming portion 70 of back-engaging portion 26

100 ninth portion of hook and loop fasteners of third portion 92 of three portions 82 of brief case-forming portion 70 of back-engaging portion 26

102 first handle-forming cutout in second portion 90 of three portions 82 of brief case-forming portion 70 of back-engaging portion 26

104 second handle-forming cutout in third portion 92 of three portions 82 of brief case-forming portion 70 of back-engaging portion 26

106 carrying handle

108 knock down golf club

110 shaft of knock down golf club 108

112 hand-gripping end of shaft 110 of knock down golf club 108

114 head-engaging end of shaft 110 of knock down golf club 108

116 pair of separate portions of shaft 110 of knock down golf club 108

118 golf club head of knock down golf club 108

120 collar of golf club head 118 of knock down golf club 108

122 depending portion in each of six golf club head-holding pockets 62 of chest-engaging portion 24

DETAILED DESCRIPTION OF THE PREFERRED EMBODIMENT

Referring now to the figures, and particularly to FIG. 1, the vest of the present invention is shown generally at 20 for a golfer 22.

The configuration of the vest 20 can best be seen in FIGS. 2–5, and as such, will be discussed with reference thereto.

The vest 20 has a carrying mode and a wearing mode and comprises a chest-engaging portion 24 for engaging the chest of the golfer 22 and a back-engaging portion 26 attached to the chest-engaging portion 24 for engaging the back of the golfer 22.

The chest-engaging portion 24 and the back-engaging portion 26 are both made of a light weight, breathable, yet durable fabric.

The chest-engaging portion 24 is sheet-like and has an chest-engaging face 28 for engaging the chest of the golfer 22, an ambient-facing face 30 for facing the ambient, a waist-engaging edge 32 for engaging the waist of the golfer 22, a neck and shoulder-engaging edge 34 for engaging the neck and shoulders of the golfer 22, and a pair of side-engaging edges 35 for engaging the sides of the golfer 22.

The back-engaging portion 26 is sheet-like and has a back-engaging face 36 for engaging the back of the golfer 22, an ambient-facing face 38 for facing the ambient, a waist-engaging edge 40 for engaging the waist of the golfer 22, a neck and shoulder-engaging edge 42 for engaging the neck and shoulders of the golfer 22, and a pair of side-engaging edges 43 for engaging the sides of the golfer 22.

The neck and shoulder-engaging edge 34 of the chest-engaging portion 24 is integral with so as to be coincident with the neck and shoulder-engaging edge 42 of the back-engaging portion 26 so as form a common fold line 44.

The common fold line 44 has a pair of ends 46 and a midpoint 48 that is midway between the pair of ends 46 of the common fold line 44.

The common fold line 44 further has a neck-engaging cutout 50 for engaging the neck of the golfer 22. The neck-engaging cutout 50 in the common fold line 44 is disposed through the midpoint 48 of the common fold line 44 and extends partially into the chest-engaging portion 24 and partially into the back-engaging portion 26.

The common fold line 44 further has a pair of shoulder-engaging cutouts 52 for engaging the shoulders of the golfer 22. Each shoulder-engaging cutout of the pair of shoulder-engaging cutouts in the common fold line 44 is disposed through an associated end of the pair of ends 46 of the common fold line 44 and extends partially into the chest-engaging portion 24 and partially the back-engaging portion 26.

The chest-engaging portion 24 further has a pair of side-engaging straps 54 that are length adjustable for engaging the sides of the golfer 22 and extend outwardly from the ambient-facing face 30 of the chest-engaging portion 24, slightly above the waist-engaging edge 32 of the chest-engaging portion 24.

Each side-engaging strap of the pair of side-engaging straps 54 of the chest-engaging portion 24 extends outwardly from a respective side-engaging edge of the pair of side-engaging edges 35 of the chest-engaging portion 24 so as to from an exposed side-engaging strap portion 56 that has a side-facing face 58 for facing a respective side of the golfer 22.

The side-facing face 58 of the exposed side-engaging portion 56 of each side-engaging strap of the pair of side-engaging straps 54 of the chest-engaging portion 24 is covered with a first portion of hook and loop fasteners 60.

The chest-engaging portion 24 further has a six golf club head-holding pockets 62 that are disposed on the ambient-facing face 30 of the chest-engaging portion 24, in two columns of three pockets each, and are small for holding small golf equipment, preferably detachable golf club heads, but also tees, score cards, pencils, or other small items needed during play.

The six golf club head-holding pockets 62 of the chest-engaging portion 24 are made from one of see-through plastic and net material.

Each pocket of the, six golf club head-holding pockets 62 of the chest-engaging portion 24 has a flap 64 for preventing -the small golf equipment held therein from unintentionally falling out.

The flap 64 of each pocket of the six golf club head-holding pockets 62 of the chest-engaging portion 24 has a second portion of hook and loop fasteners thereon that mates with a third mating portion of the hook and loop fasteners disposed on an associated pocket of the six golf club head-holding pockets 62 of the chest-engaging portion 24 so as to maintain the associated pocket of the six golf club head-holding pockets 62 of the chest-engaging portion 24 closed.

The back-engaging portion 26 further has a fourth pair of mating portions of hook and hoop fasteners 66 that are disposed on the ambient-facing face 38 of the back-engaging portion 26, slightly above the waist-engaging edge 40 of the back-engaging portion 26.

Each mating portion of hook and loop fasteners of the fourth pair of mating portions of hook and loop fasteners 66 of the back-engaging portion 26 is disposed at a respective side-engaging edge of the pair of side-engaging edges 43 of the back-engaging portion 26 and selectively mates with an associated portion of hook and loop fasteners of the first portions of hook and loop fasteners 60 on the side-facing face 58 of the exposed side-engaging portion 56 of each side-engaging strap of the pair of side-engaging straps 54 of the chest-engaging portion 24.

The back-engaging portion 26 further has a pair of golf club shaft-holding pockets 68 that are disposed on the ambient-facing face 38 of the back-engaging portion 24, side by side, and are long, narrow, and vertically-oriented for holding one of whole and segmented golf club shafts, such as for a putter or an iron.

The pair of golf club shaft-holding pockets 62 of the back-engaging portion 26 are made from see-through material.

The back-engaging portion 26 further has a brief case-forming extended portion 70 that is sheet-like and has a first edge 72 that is integral with so as to be coincident with the waist-engaging edge 40 of the back-engaging portion 26 so as to form a first lateral fold line 74 therewith.

The brief case-forming portion 70 of the back-engaging portion 26 further has a pair of side edges 76 and a free lateral edge 77. Each side edge of the pair of side edges 76 of the brief case-forming portion 70 of the back-engaging portion 26 extends colinearly from a respective side-engaging edge of the pair of side-engaging edges 43 of the back-engaging portion 26.

The brief case-forming portion 70 of the back-engaging portion 26 further has a first face 78 that is continuous with the back-engaging face 36 of the back-engaging 26.

The brief case-forming portion 70 of the back-engaging portion 26 further has a second face 80 that is continuous with the ambient-facing face 38 of the back-engaging 26.

The brief case-forming portion 70 of the back-engaging portion 26 is divided longitudinally into three portions 82 by a second lateral fold line 84 and a third lateral fold line 86.

The three portions 82 of the brief case-forming portion 70 of the back-engaging portion 26 comprises a first portion 88 that is defined by the first lateral fold line 74 and the second lateral fold line 84.

The three portions 82 of the brief case-forming portion 70 of the back-engaging portion 26 further comprises a second portion 90 that is defined by the second lateral fold line 84 and the third lateral fold line 86 and is much lower in height than the first portion 88 of the three portions 82 of the brief case-forming portion 70 of the back-engaging portion 26.

The three portions 82 of the brief case-forming portion 70 of the back-engaging portion 26 further comprises a third portion 92 that is defined by the third lateral fold line 86 and the free lateral edge 77 of the brief case-forming portion 70 of the back-engaging portion 26 and is slightly lower in height than the second portion 90 of the three portions 82 of the brief case-forming portion 70 of the back-engaging portion 26.

The back-engaging portion 26 further has a fifth portion of hook and loop fasteners 93 that extends transversely across the ambient-facing face 38 of the of the back-engaging portion 26, from short of one side-engaging edge of the pair of side-engaging edges 43 of the back-engaging portion 26 to short of another side-engaging edge of the pair of side-engaging edges 43 of the back-engaging portion 26, and is disposed just below the neck-engaging cutout 50 in the common fold line 44.

The back-engaging portion 26 further has a sixth portion of hook and loop fasteners 94 that extends transversely across the back-engaging face 36 of the back-engaging portion 26, from short of one side-engaging edge of the pair of side-engaging edges 43 of the back-engaging portion 26 to short of another side-engaging edge of the pair of side-engaging edges 43 of the back-engaging portion 26, and is disposed just below and is longer than the fifth portion of hook and loop fasteners 93 of the back-engaging portion 26.

The first portion 88 of the three portions 82 of the brief case-forming portion 70 of the back-engaging portion 26 has a seventh portion of hook and loop fasteners 96 that extends transversely across the first face 78 of the brief case-forming portion 70 of the back-engaging portion 26, from short of one side edge of the pair of side edges 76 of the brief case-forming portion 70 of the back-engaging portion 26 to short of another side edge of the pair of side edges 76 of the brief case-forming portion 70 of the back-engaging portion 26, and is disposed between the first lateral fold line 74 and the second lateral fold line 84, and is as long as the fifth portion of hook and loop fasteners 93 of the back-engaging portion 26.

The second portion 90 of the three portions 82 of the brief case-forming portion 70 of the back-engaging portion 26 has an eighth portion of hook and loop fasteners 98 that extends transversely across the second face 80 of the brief case-forming portion 70 of the back-engaging portion 26, from short of one side edge of the pair of side edges 76 of the brief case-forming portion 70 of the back-engaging portion 26 to short of another side edge of the pair of side edges 76 of the brief case-forming portion 70 of the back-engaging portion 26, and is disposed adjacent the second lateral fold line 84, and is as long as and selectively mates with the sixth portion of hook and loop fasteners 94 of the back-engaging portion 26.

The third portion 92 of the three portions 82 of the brief case-forming portion 70 of the back-engaging portion 26 has a ninth portion of hook and loop fasteners 100 that extends transversely across the first face 78 of the brief case-forming portion 70 of the back-engaging portion 26, from short of one side edge of the pair of side edges 76 of the brief case-forming portion 70 of the back-engaging portion 26 to short of another side edge of the pair of side edges 76 of the brief case-forming portion 70 of the back-engaging portion 26, and is disposed adjacent the free lateral edge 77 of the brief case-forming portion 70 of the back-engaging portion 26, and is as long as and mates with the fifth portion of hook and loop fasteners 93 of the back-engaging portion 26 when the vest 20 is in the carrying mode and mates with the seventh portion of hook and loop fasteners 96 of the first portion 88 of the three portions 82 of the brief case-forming portion 70 of the back-engaging portion 26 when the vest 20 is in the wearing mode.

The second portion 90 of the three portions 82 of the brief case-forming portion 70 of the back-engaging portion 26 further has a first handle-forming cutout 102 that extends centrally therethrough, and is disposed adjacent to the third lateral fold line 86.

The third portion 92 of the three portions 82 of the brief case-forming portion 70 of the back-engaging portion 26 further has a second handle-forming cutout 104 that extends centrally therethrough, and is disposed adjacent to the third lateral fold line 86, and forms with the first handle-forming cutout 102 in the second portion 90 of the three portions 82 of the brief case-forming portion 70 of the back-engaging portion 26 a carrying handle 106 therebetween that is used when the vest 20 is in the carrying mode.

The method for the vest 20 to achieve the wearing position can best be seen in FIGS. 6–8, and as such, will be discussed with reference thereto.

STEP 1: The second portion 90 of the three portions 82 of the brief case-forming portion 70 of the back-engaging portion 26 and the third portion 92 of the three portions 82 of the brief case-forming portion 70 of the back-engaging portion 26 are folded as a coplanar unit on the second lateral fold line 84 onto the second face 80 of the-brief case-forming portion 70 of the back-engaging portion 26.

STEP 2: The ninth portion of hook and loop fasteners 100 is engaged with the seventh portion of hook and loop fasteners 96 so as to form an initial folded flat portion.

STEP 3: The first folded portion is folded on the first lateral fold line 74 onto the back-engaging face 36 of the back-engaging portion 26.

STEP 4: The eighth portion of hook and loop fasteners 98 is engaged with the sixth portion of hook and loop fasteners 94 so as to form a final folded flat portion.

The method for the vest 20 to achieve the carrying position can best be seen in FIGS. 9–12, and as such, will be discussed with reference thereto.

STEP 1: The chest-engaging portion 24 is folded on the common fold line 44 onto the back-engaging portion 26, with the chest-engaging face 28 of the chest-engaging portion 24 facing the back-engaging face 36 of the back-engaging 26 so as to form an initial folded flat portion.

STEP 2: The first portion 88 of the three portions 82 of the brief case-forming portion 70 of the back-engaging portion 26, the second portion 90 of the three portions 82 of the brief case-forming portion 70 of the back-engaging portion 26, and the third portion 92 of the three portions 82 of the brief case-forming portion 70 of the back-engaging portion 26 are folded as a unit on the first lateral fold line 74 onto the ambient-facing face 30 of the chest-engaging portion 24 so as to form an intermediate folded flat portion.

STEP 3: The third portion 92 of the three portions 82 of the brief case-forming portion 70 of the back-engaging portion 26 is folded on the third lateral fold line 86 over the common fold line 44 onto the ambient-facing face 38 of the back-engaging portion 26 so as to form a final folded flat portion.

STEP 4: The ninth portion of hook and loop fasteners 100 is engaged with the fifth portion of hook and loop fasteners 93.

The vest 20 further comprises a knock down golf club 108 whose configuration can best be seen in FIGS. 3, 13, and 14, and as such, will be discussed with reference thereto.

The knock down golf club 108 comprises a shaft 110 having a hand-gripping end 112 and a head-engaging end 114.

The shaft 110 of the knock down golf club 108 comprises a pair of separate portions 116 that are disposed end to end in collinear relationship and threadably engaged to each other so as to allow the shaft 110 of the knock down golf club 108 to be separated into the pair of separate portions 116 of the shaft 110 of the knock down golf club 108 and stored in one of the pair of golf club shaft-holding pockets 68 of the back-engaging portion 26.

The knock down ,golf club 108 further comprises a golf club head 118 that is detachably threaded onto the head-engaging end 114 of the shaft 110 of the knock down golf club 108 so as to allow the golf club head 118 of the knock down golf club 108 to be separated from the shaft 110 of the knock down golf club 108 and stored in one of the six golf club head-holding pockets 62 of the chest-engaging portion 24.

The golf club head 118 of the knock down golf club 108 has a collar 120 that threadably receives the head-engaging end 114 of the shaft 110 of the knock down golf club 108 and which is received by a depending portion 122 in the one of the six golf club head-holding pockets 62 of the chest-engaging portion 24 so as to allow the golf club head of the 118 of the knock down golf club 108 to be form fitted in the one of the six golf club head-holding pockets 62 of the chest-engaging portion 24.

It will be understood that each of the elements described above, or two or more together, may also find a useful application in other types of constructions differing from the types described above.

While the invention has been illustrated and described as embodied in a vest for a golfer, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A combination vest and golf club for a golfer, wherein said vest has a carrying mode and a wearing mode, said vest comprising:

a) a chest-engaging portion for engaging the chest of the golfer; said chest-engaging portion being sheet-like and having:
   i) a chest-engaging face for engaging the chest of the golfer;
   ii) an ambient-facing face for facing the ambient:
   iii) a waist-engaging edge for engaging the waist of the golfer;
   iv) a neck and shoulder-engaging edge for engaging the neck and shoulders of the golfer; and
   v) a pair of side-engaging edges for engaging the sides of the golfer; and b) a back-engaging portion attached to said chest-engaging portion for engaging the back of the golfer; said back-engaging portion being sheet-like and having:
   i) a back-engaging face for engaging the back of the golfer;
   ii) an ambient-facing face for facing the ambient;
   iii) a waist-engaging edge for engaging the waist of the golfer;
   iv) a neck and shoulder-engaging edge for engaging the neck and shoulders of the golfer; said neck and shoulder-engaging edge of said chest-engaging portion being integral with so as to be coincident with said neck and shoulder-engaging edge of said back-engaging portion so as form a common fold line; said common fold line having:

1) a pair of ends;
2) a midpoint being midway between said pair of ends of said common fold line; and
3) a neck-engaging cutout for engaging the neck of the golfer;

v) a pair of side-engaging edges for engaging the sides of the golfer;

vi) a brief case-forming extended portion being sheet-like and having:
1) a first edge being integral with so as to be coincident with said waist-engaging edge of said back-engaging portion so as to form a first lateral fold line therewith;
2) a pair of side edges;
3) a free lateral edge;
4) a first face being continuous with said back-engaging face of said back-engaging portion; and
5) a second face being continuous with said ambient-facing face of said back-engaging portion;

said brief case-forming portion of said back-engaging portion being divided longitudinally into three portions by a second lateral fold line and a third lateral fold line; said three portions of said brief case-forming portion of said back-engaging portion comprising:
1) a first portion being defined by said first lateral fold line and said second lateral fold line;
2) a second portion being defined by said second lateral fold line and said third lateral fold line and being much lower in height than said first portion of said three portions of said brief case-forming portion of said back-engaging portion; and
3) a third portion being defined by said third lateral fold line and said free lateral edge of said brief case-forming portion of said back-engaging portion and being slightly lower in height than said second portion of said three portions of said brief case-forming portion of said back-engaging portion; and vii) a fifth portion of hook and loon fasteners extending transversely across said ambient-facing face of said back-engaging portion, from short of one side-engaging edge of said pair of side-engaging edges of said back-engaging portion to short of another side-engaging edge of said pair of side-enraging edges of said back-engaging portion, and being disposed just below said neck-engaging cutout in said common fold line.

2. The combination as defined in claim 1, wherein said chest-engaging portion and said back-engaging portion are both made of a light weight, breathable, yet durable fabric.

3. The combination as defined in claim 1, wherein said neck-engaging cutout in said common fold line is disposed through said midpoint of said common fold line and extends partially into said chest-engaging portion and partially into said back-engaging portion.

4. The combination as defined in claim 1, wherein said common fold line further has a pair of shoulder-engaging cutouts for engaging the shoulders of the golfer.

5. The combination as defined in claim 4, wherein each shoulder-engaging cutout of said pair of shoulder-engaging cutouts in said common fold line is disposed through an associated end of said pair of ends of said common fold line and extends partially into said chest-engaging portion and partially into said back-engaging portion.

6. The combination as defined in claim 1, wherein said chest-engaging portion further has a pair of side-engaging straps that are length adjustable for engaging the sides of the golfer ;end extend outwardly from said ambient-facing face of said chest-engaging portion, slightly above said waist-engaging edge of said chest-engaging portion.

7. The combination as defined in claim 6, wherein each side-engaging strap of said pair of side-engaging straps of said chest-engaging portion extends outwardly from a respective side-engaging edge of said pair of side-engaging edges of said chest-engaging portion so as to from an exposed side-engaging strap portion that has a side-facing face for facing a respective side of the golfer.

8. The combination as defined in claim 7, wherein said side-facing face of said exposed side-engaging portion of each side-engaging strap of said pair of side-engaging straps of said chest-engaging portion is covered with a first portion of hook and loop fasteners.

9. The combination as defined in claim 1, wherein said chest-engaging portion further has six golf club head-holding pockets that are disposed on said ambient-facing face of said chest-engaging portion, in two columns of three pockets each, and are small for holding detachable golf club heads.

10. The combination as defined in claim 9, wherein said six golf club head-holding pockets of said chest-engaging portion are made from one of see-through plastic and net material.

11. The combination as defined in claim 9, wherein each pocket of said six golf club head-holding pockets of said chest-engaging portion has a flap for preventing the detachable golf club head held therein from unintentionally falling out.

12. The combination as defined in claim 11, wherein said flap of each, pocket of said six golf club head-holding pockets of said chest-engaging portion has a second portion of hook and loop fasteners thereon that mates with a third mating portion of said hook and loop fasteners disposed on an associated pocket of said six golf club head-holding pockets of said chest-engaging portion so as to maintain said associated pocket of said six golf club head-holding pockets of said chest-engaging portion closed.

13. The combination as defined in claim 8, wherein said back-engaging portion further has a fourth pair of mating portions of hook and hoop fasteners that are disposed on said ambient-facing face of said back-engaging portion, slightly above said waist-engaging edge of said back-engaging portion.

14. The combination as defined in claim 13, wherein each mating portion of hook and loop fasteners of said fourth pair of mating portions of hook and loop fasteners of said back-engaging portion is disposed at a respective side-engaging edge of said pair of side-engaging edges of said back-engaging portion and selectively mates with an associated portion of hook and loop fasteners of said first portions of hook and loop fasteners on said side-facing face of said exposed side-engaging portion of each side-engaging strap of said pair of side-engaging straps of said chest-engaging portion.

15. The combination as defined in claim 9, wherein said back-engaging portion further has a pair of golf club shaft-holding pockets that are disposed on said ambient-facing face of said back-engaging portion, side by side, and are long, narrow, and vertically-oriented for holding one of whole and segmented golf club shafts.

16. The combination as defined in claim 15, wherein said pair of golf club shaft-holding pockets of said back-engaging portion are made from see-through material.

17. The combination as defined in claim 1, wherein each side edge of said pair of side edges of said brief case-forming portion of said back-engaging portion extends colinearly from a respective side-engaging edge of said pair of side-engaging edges of said back-engaging portion.

18. The combination as defined in claim 1, wherein said back-engaging portion further has a sixth portion of hook and loop fasteners that extends transversely across said back-engaging face of said of said back-engaging portion, from short of one side-engaging edge of said pair of side-engaging edges of said back-engaging portion to short of another side-engaging edge of said pair of side-engaging edges of said back-engaging portion, and is disposed just below and is longer than said fifth portion of hook and loop fasteners of said back-engaging portion.

19. The combination as defined in claim 1, wherein said first portion of said three portions of said brief case-forming portion of said back-engaging portion has a seventh portion of hook and loop fasteners that extends transversely across said first face of said brief case-forming portion of said back-engaging portion, from short of one side edge of said pair of side edges of said brief case-forming portion of said back-engaging portion to short of another side edge of said pair of side edges of said brief case-forming portion of said back-engaging portion, and is disposed between said first lateral fold line and said second lateral fold line, and is as long as said fifth portion of hook and loop fasteners of said back-engaging portion.

20. The combination as defined in claim 18, wherein said second portion of said three portions of said brief case-forming portion of said back-engaging portion has an eighth portion of hook and loop fasteners that extends transversely across said second face of said brief case-forming portion of said back-engaging portion, from short of one side edge of said pair of side edges of said brief case-forming portion of said back-engaging portion to short of another side edge of said pair of side edges of said brief case-forming portion of said back-engaging portion, and is disposed adjacent said second lateral fold line, and is as long as and selectively mates with said sixth portion of hook and loop fasteners of said back-engaging portion.

21. The combination as defined in claim 19, wherein said third portion of said three portions of said brief case-forming portion of said back-engaging portion has a ninth portion of hook and loop fasteners that extends transversely across said first face of said brief case-forming portion of said back-engaging portion, from short of one side edge of said pair of side edges of said brief case-forming portion of said back-engaging portion to short of another side edge of said pair of side edges of said brief case-forming portion of said back-engaging portion, and is disposed adjacent said free lateral edge of said brief case-forming portion of said back-engaging portion, and is as long as and mates with said fifth portion of hook and loop fasteners/ of said back-engaging portion when said vest is in said carrying mode and mates with said seventh portion of hook and loop fasteners of said first portion of said three portions of said brief case-forming portion of said back-engaging portion when said vest is in said wearing mode.

22. The combination as defined in claim 1, wherein said second portion of said three portions of said brief case-forming portion of said back-engaging portion further has a first handle-forming cutout that extends centrally therethrough, and is disposed adjacent to said third lateral fold line.

23. The combination as defined in claim 22, wherein said third portion of said three portions of said brief case-forming portion of said back-engaging portion further has a second handle-forming cutout that extends centrally therethrough, and is disposed adjacent to said third lateral fold line, and forms with said first handle-forming cutout in said second portion of said three portions of said brief case-forming portion of said back-engaging portion a carrying handle therebetween that is used when said vest is in said carrying mode.

24. The combination as defined in claim 15; further comprising a knock down golf club comprising a shaft having:

a) a hand-gripping end; and b) a head-engaging end.

25. The combination as defined in claim 24, wherein said shaft of said knock down golf club comprises a pair of separate portions that are disposed end to end in collinear relationship and threadably engaged to each other so as to allow said shaft of said knock down golf club to be separated into said pair of separate portions of said shaft of said knock down golf club and stored in one of said pair of golf club shaft-holding pockets of said back-engaging portion.

26. The combination as defined in claim 24, wherein said knock down golf club further comprises a golf club head that is detachably threaded onto said head-engaging end of said shaft of said knock down golf club so as to allow said golf club head of said knock down golf club to be separated from said shaft of said knock down golf club and stored in one of said six golf club head-holding pockets of said chest-engaging portion.

27. The combination as defined in claim 26, wherein said golf club heed of said knock down golf club has a collar that threadably receives said head-engaging end of said shaft of said knock down golf club and which is received by a depending portion in said one of said six golf club head-holding pockets of said chest-engaging portion so as to allow said golf club head of said of said knock down golf club to be form fitted in said one of said six golf club head-holding pockets of said chest-engaging portion.

* * * * *